US006529224B2

(12) United States Patent
Shirakawa et al.

(10) Patent No.: US 6,529,224 B2
(45) Date of Patent: Mar. 4, 2003

(54) THERMAL HEAD ENABLING CONTINUOUS PRINTING WITHOUT PRINT QUALITY DETERIORATION

(75) Inventors: Takashi Shirakawa, Iwate-ken (JP); Toshifumi Nakatani, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/115,471

(22) Filed: Apr. 3, 2002

(65) Prior Publication Data

US 2002/0145658 A1 Oct. 10, 2002

(30) Foreign Application Priority Data

Apr. 5, 2001 (JP) ..... 2001-107323

(51) Int. Cl.[7] ..... B41J 2/335
(52) U.S. Cl. ..... 347/200; 347/202
(58) Field of Search ..... 347/200, 202, 347/203, 204, 205

(56) References Cited

U.S. PATENT DOCUMENTS 5,940,109 A * 8/1999 Taniguchi et al. ..... 347/205
5,949,465 A * 9/1999 Taniguchi et al. ..... 347/205

FOREIGN PATENT DOCUMENTS

| | | | |
|---|---|---|---|
| JP | 51-90834 | 8/1976 | |
| JP | 61-261068 | * 11/1986 | ..... B41J/3/20 |
| JP | 03-21352 | 3/1991 | |
| JP | 8-11337 | 1/1996 | |
| JP | 08-67022 | * 3/1996 | ..... B41J/2/335 |

* cited by examiner

*Primary Examiner*—Huan Tran
(74) *Attorney, Agent, or Firm*—Brinks Hofer Gilson & Lione

(57) ABSTRACT

In a thermal head according to the present invention, a sacrificial layer of transition metal is formed on a top surface of a heat radiation substrate; a bridge layer of cermet or ceramic material is formed on a top surface of a heat insulation layer including the sacrificial layer; a cavity is made between the bridge layer and the heat insulation layer; a plurality of slits are made in the bridge layer overlying the cavity to expose the cavity; a highly adiabatic inorganic heat insulation layer is formed on a top surface of the bridge layer including the slits; and an inorganic protective layer of a material selected from among silicon or aluminum oxide, nitride and carbide is formed on a top surface of the inorganic heat insulation layer, where heating elements are formed between the slits over the inorganic heat insulation layer and the inorganic protective layer

8 Claims, 3 Drawing Sheets

THERMAL HEAD ENABLING CONTINUOUS PRINTING WITHOUT PRINT QUALITY DETERIORATION

BACKGROUND OF THE INVENTION

1. Field of the Invention

The present invention relates to a highly efficient thermal head which is used for a thermal printer.

2. Description of the Related Art

In a typical conventional thermal head, a glaze heat insulation layer 2 with a thickness of approximately 80 $\mu$m is wholly or partially formed on the end of a heat radiation substrate 1 made of alumina or similar material, as shown in FIG. 5.

A convex 2*a* with a height of approximately 5 $\mu$m is formed on the surface of this glaze heat insulation layer 2 by a photolithographic technique.

Also, heating resistors 3 made of $Ta_2N$, Ta—$SiO_2$, etc. are formed on the top surface of the glaze heat insulation layer 2 including the ridge-like convex 2*a* by sputtering and then the heating resistors 3 are processed so as to make up a pattern by a photolithographic technique.

Approximately 2-$\mu$m-thick electrodes for supplying an electrical energy to the heating resistors 3 are formed on the top surfaces of the heating resistors 3 by sputtering with Al, Cu, Au, etc.

Then the electrodes are etched by a photolithographic technique to make common electrodes 4 and individual electrodes 5 and external connection terminals (not shown) for the electrodes 4 and 5.

In order to protect the heating resistors 3 and electrodes 4 and 5 against oxidation and abrasion, an abrasion-resistant layer 6 of hard ceramic such as Si—O—N or Si—Al—O—N which is resistant to oxidation and abrasion is coated with a thickness of 5 to 10 $\mu$m over the heating resistors 3 and electrodes 4 and 5 by sputtering or a similar technique; thus durability in printing is ensured.

This conventional thermal head laminate is bonded to a heat sink 7 composed of an aluminum member, etc. using a resin adhesive 8 in a manner that the heat which is accumulated on the heat radiation substrate 1 during printing may be radiated to the outside; this finished thermal head is mounted into a thermal printer or the like.

In this type of conventional thermal head, Joule heat is generated on the heating resistors 3 to heat heat-sensitive paper or a thermal transfer ink ribbon (not shown) so that characters and images are printed by heat-sensitive paper coloring or ink transfer from the ink ribbon to recording paper such as plain paper.

The recent trend in thermal printers with a conventional thermal head as mentioned above is a compact, lightweight portable model capable of battery-powered operation.

In such a portable thermal printer capable of battery-powered operation, the element which consumes power most is a thermal head since it has a plurality of heating resistors 3.

For the purpose of power saving in a conventional thermal head, the glaze heat insulation layer 2 has been made thicker than before, in order to store more heat.

However, since this conventional thermal head relies only on the approach of increasing the thickness of the glaze insulation layer 2, there may occur an excessive heat accumulation when the printer is run continuously; as a result, when it is used, for example, in a thermal transfer printer, ink from the ink ribbon may be transferred beyond the printing area, causing the phenomenon of trailing in printed image, or a poor print quality.

SUMMARY OF THE INVENTION

The present invention is made in view of the above problem and an object of the invention is to provide a thermal head which does not cause deterioration in print quality even in continuous printing or a similar condition and consumes less power than conventional models, and a manufacturing method therefor.

As a first solution to the above problem, the present invention provides a thermal head comprising: a heat insulation layer formed on a top surface of a heat radiation substrate; a plurality of heating elements lined up on a top surface of the heat insulation layer; and an abrasion-resistant layer covering at least the top surfaces of the heating elements, wherein a sacrificial layer of transition metal is formed on a top surface of the heat radiation substrate; a bridge layer of cermet or ceramic material is formed on a top surface of the heat insulation layer including the sacrificial layer; a cavity is made between the bridge layer and the heat insulation layer; a plurality of slits are made in the bridge layer overlying the cavity to expose the cavity; a highly adiabatic inorganic heat insulation layer is formed on a top surface of the bridge layer including the slits; and an inorganic protective layer of a material selected from among silicon or aluminum oxide, nitride and carbide is formed on a top surface of the inorganic heat insulation layer, the heating elements are formed between neighboring ones of the slits over the inorganic heat insulation layer and the inorganic protective layer.

As a second solution to the problem, the heating elements are formed on the inorganic protective layer's area projecting upward due to the cavity, and the thickness of electrodes is so designed that they are flush with or lower than the heating elements.

As a third solution to the problem, the bridge layer is made of a cermet as a compound of a metal with a high melting point and $SiO_2$ or a ceramic such as $SiO_2$, $Si_3N_4$ or Si—O—N.

As a fourth solution to the problem, the inorganic heat insulation layer is made of a complex oxide or complex nitride as a compound of silicon, transition metal and oxygen or nitrogen, and its thickness is from 5 $\mu$m to 20 $\mu$m and its thermal diffusivity from 0.3 $mm^2$/sec to 0.4 $mm^2$/sec.

As a fifth solution to the problem, the inorganic protective layer is made of an insulating ceramic such as $SiO_2$, SiC, Si—Al—O, $Al_2O_3$ or AlN with a thickness of 0.1 to 1 $\mu$m.

BRIEF DESCRIPTION OF THE DRAWINGS

The invention will be more particularly described with reference to the accompanying drawings, in which.

DETAILED DESCRIPTION OF THE PREFERRED EMBODIMENTS

Figure 1:
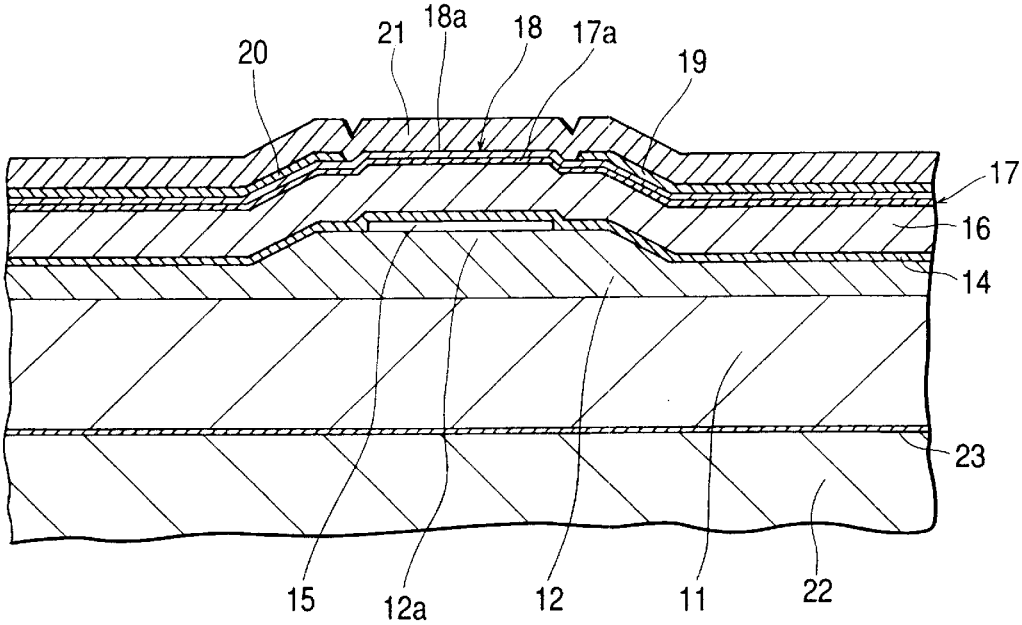
FIG. 1 is a sectional view of the key part of a thermal head according to an embodiment of the present invention.
Figure 2:
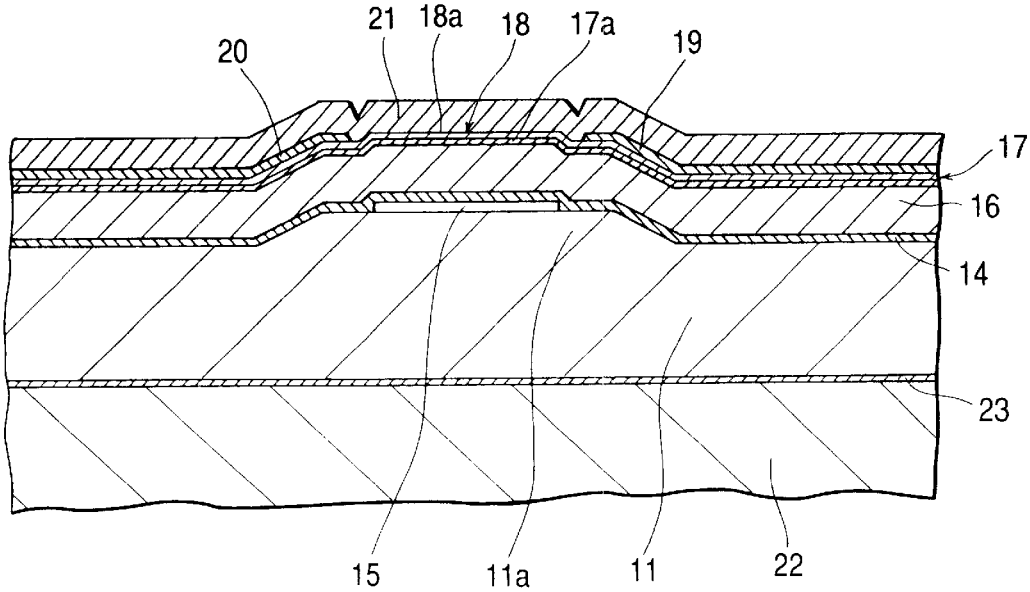
FIG. 2 is a sectional view of the key part of a thermal head according to another embodiment of the present invention.
Figure 3A:
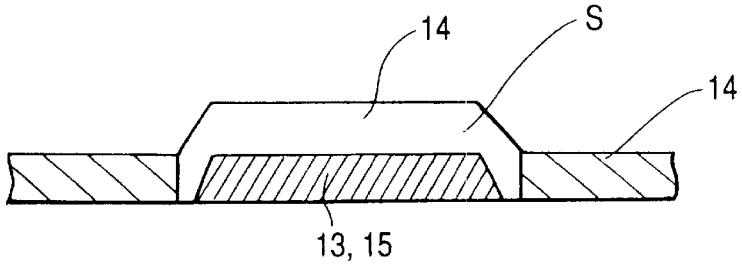
FIG. 3A is a partially enlarged sectional view and FIG. 3B is a partially enlarged top view according to the present invention.
Figure 3B:
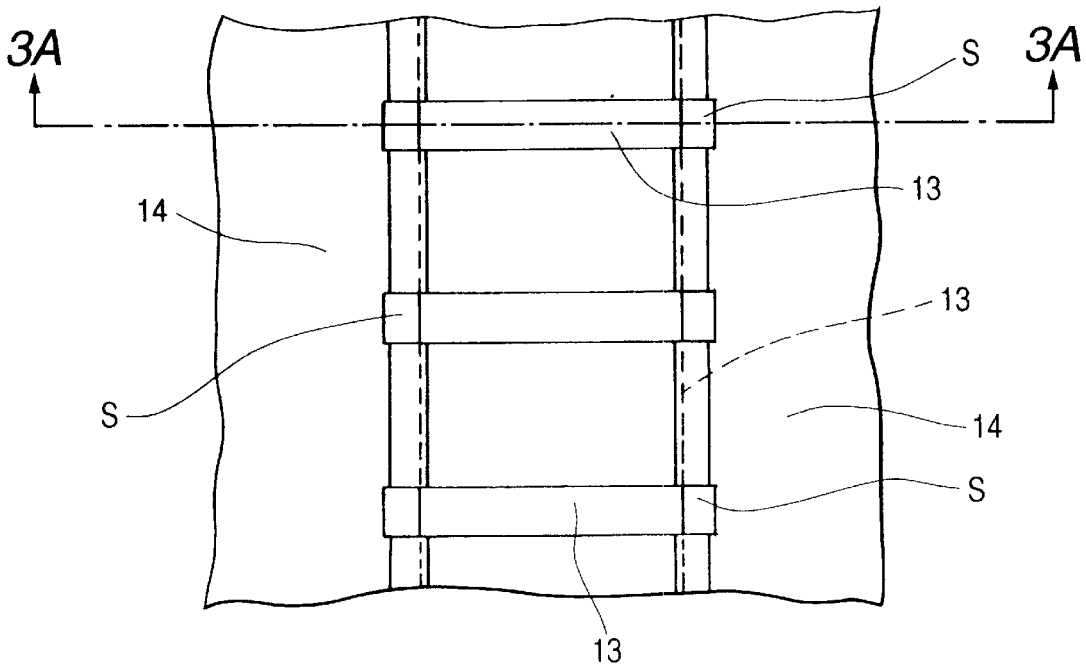
Figure 4:
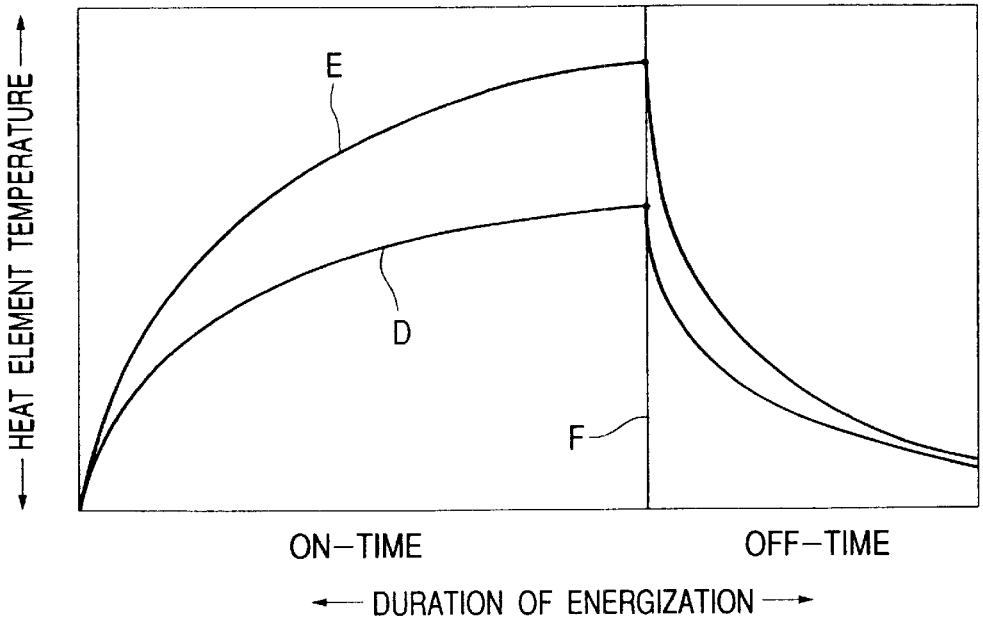
FIG. 4 is a graph showing resistance to foreign matters of a thermal head according to the present invention.
Figure 5:
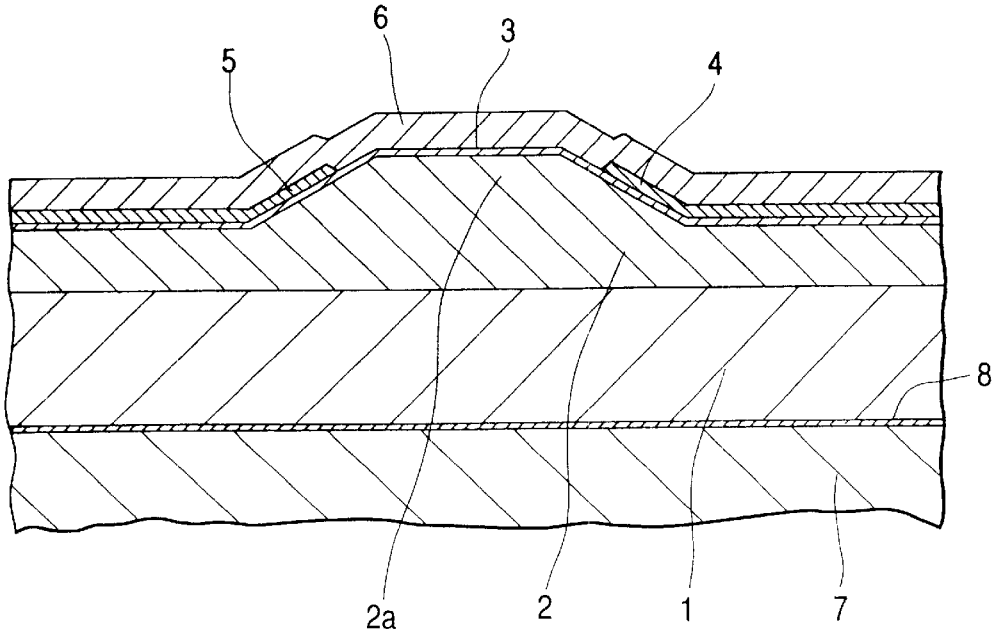
FIG. 5 PRIOR ART
FIG. 5 is a sectional view of the key part of a conventional thermal head.

Next, a thermal head according to the present invention and a manufacturing method therefor will be described referring to the accompanying drawings. FIG. 1 is a sectional view of the key part of a thermal head according to an embodiment of the present invention; FIG. 2 is a sectional view of the key part of a thermal head according to another embodiment of the present invention; FIGS. 3A and 3B illustrate the method for making a cavity in a thermal head according to the present invention; and FIG. 4 is a graph which compares a thermal head according to the present invention with a conventional one in terms of thermal response.

As shown in FIG. 1, a 20- to 80-$\mu$m-thick heat insulation layer 12 of glass or heat-resistant resin such as polyimide resin is formed on the top surface of a heat radiation substrate 11 made of alumina or a similar material.

A convex 12*a* having a virtually trapezoidal cross section is formed on the surface of the heat insulation layer 12 in the form of a ridge whose height ranges from 5 to 10 $\mu$m.

A bridge layer 14 with a thickness of approximately 1$\mu$m is formed on the top surface of the heat insulation layer 12 including the convex 12*a,* where the bridge layer is made of a cermet material for heating resistors 18 (stated later) such as $TaSiO_2$ or a ceramic material such as $SiO_2$, $Si_3N_4$ or Si—O—N.

There is a cavity 15 with a height (clearance) of 0.1 to 2 $\mu$m on the top of the convex 12*a* between its surface and the bridge layer 14. As shown in FIG. 3, there are plural slits S spaced with a prescribed pitch in the area of the bridge layer 14 where this cavity 15 lies; the inside of the cavity 15 is exposed through the slits S.

Heating resistors 18*a* lie over each bridge area between slits S through an inorganic heat insulation layer 16 and an inorganic protective layer 17 (both stated later)

An inorganic heat insulation layer 16 of highly adiabatic and adhesive ceramic is formed on the top surface of the bridge layer 14 including the slits S.

This inorganic heat insulation layer 16 is a layer of highly adiabatic and adhesive ceramic with a thickness of 5 to 20 $\mu$m as a compound of Si, transition metal and oxygen and/or nitrogen.

In other words, the inorganic heat insulation layer 16 consists of a ceramic having one of the following combinations of ingredients: Si, a metal with a high melting point and oxygen; and Si, a metal with a high melting point, and nitrogen. Its thermal diffusivity is from 0.3 $mm^2$/sec to 0.4 $mm^2$/sec.

In addition, a highly adiabatic 0.1- to 1-$\mu$m-thick inorganic protective layer 17, made of such a material as $SiO_2$, SiC, Si—Al—O, $Al_2O_3$ or AlN, is formed on the top surface of the inorganic heat insulation layer 16 in order to protect the inorganic heat insulation layer 16 electrically, chemically and mechanically. This inorganic protective layer 17 has a convex 17*a* which projects upwards due to the cavity 15.

On the top surface of the inorganic protective layer 17, there are heating resistors 18 made of a cermet consisting of Ta-$SiO_2$ and the like based on a metal with a high melting point. The heating resistors 18 consist of heating elements 18*a* lined up like dots on the convex 17*a* of the inorganic protective layer 17.

A 1-to 2-$\mu$m-thick layer of power supplying material containing Al, Cu, Au, etc. is formed at each side of the heating elements 18*a*; the layer at one side constitutes common electrodes 19 and the layer at the other side constitutes individual electrodes 20 and the heating elements 18*a* are sandwiched between these electrodes.

The electrodes 19 and 20 are as high as or lower than the heating elements 18*a*.

The heating elements 18*a* lie between slits S, over the inorganic heat insulation layer 16 and the inorganic protective layer 17.

An abrasion-resistant layer 21 of Si—O—N, Si—Al—O—N or the like with a thickness of approximately 5 $\mu$m covers the top surfaces of the heating resistors 18 and the electrodes 19 and 20.

According to the present invention, the laminate as described above is bonded to a metal heat sink 22 using an adhesive agent 23 and then the thermal head thus finished is mounted in a printer such as a battery-powered photo printer or portable mobile printer.

According to another embodiment of the present invention, as shown in FIG. 2, a heat radiation substrate 11 is made of silicon or metal; a ridge-like convex 11*a* is integrally formed on the surface of the heat radiation substrate 11 by a photolithographic or press technique and a bridge layer 14 is formed directly on the heat radiation substrate 11.

The thermal response characteristic of a thermal head according to the present invention will be explained referring to FIG. 4. The vertical axis represents change in heating element temperature when the thermal head is energized while the horizontal axis represents the duration of energization. F represents the time when the power is turned off.

Graph D shows the thermal response characteristic of a conventional thermal head and graph E shows that of a thermal head according to the present invention.

As illustrated by graph E and graph D in the figure, as a certain level of electric power is supplied to the conventional thermal head and the thermal head according to the present invention, the temperature of the heating elements 18*a* of the thermal head according to the present invention, which has a cavity 15, rises more quickly and are higher than that of the conventional thermal head, which has no cavity.

When the power to the thermal head is turned off at time F, or after a prescribed duration of energization, the temperature of the thermal head according to the invention (expressed by E) decreases more gradually than that of the conventional one (expressed by D), because E is higher than D during energization.

In such a thermal head according to the present invention, the highly adiabatic cavity 15 lies under the heating elements 18*a* with the inorganic heat insulation layer 16 and the inorganic protective layer 17 lying in-between so that thermal diffusion from the heating resistors 18 to the heat radiation substrate 11 is considerably reduced and a high heat accumulation efficiency is assured.

When the accumulated heat exceeds a certain temperature, it can be efficiently radiated toward the heat radiation substrate 11.

Therefore, the heating elements 18*a* can be heated in a shorter time to a temperature at which printing becomes possible and even in continuous printing, the heat accumulated in the inorganic heat insulation layer 16 and the heat insulation layer 12 can be efficiently radiated.

In addition, the thermal head according to the present invention requires less electrical energy to be supplied to the heating resistors 18 to heat the heating elements 18*a* to a temperature at which printing becomes possible, than the conventional thermal head.

In short, the thermal head according to the present invention increases the thermal efficiency and consumes less power, contributing to power saving in portable thermal printers and similar printers.

The method for manufacturing such a high efficiency thermal head will be explained next focusing on the cavity 15. First, in the chamber (vacuum atmosphere) of a vacuum evaporator (not shown), a selectively etchable sacrificial layer 13 is formed on the convex 12*a* of the heat insulation layer 12 of glaze or polyimide resin, like a belt as shown in FIG. 3B.

Then, as shown in FIG. 3A, a bridge layer 14 is formed on the top surface of the heat insulation layer 12 including the sacrificial layer 13 and plural slits S which are shaped as desired and spaced with a prescribed pitch are made in the bridge layer 14 lying over the sacrificial layer 13 by a photolithographic technique in a manner that the underlying sacrificial layer 13 is exposed through these slits S.

Heating elements 18*a* are formed above each area of the bridge layer 14 between neighboring slits S by the intermediation of the inorganic heat insulation layer 16 and the inorganic protective layer 17 which lie in-between.

Next, the sacrificial layer 13 is dissolved and removed by pouring a selective etchant through the slits S. As a consequence, a cavity 15 as shown in FIG. 1 is formed between the bridge layer 14 and the surface of the convex 12*a* of the heat insulating layer 12 on which the sacrificial layer 13 lies.

Then, a highly adiabatic and adhesive inorganic heat insulation layer 16, made of a complex oxide or nitride, is formed on the bridge layer 14 including the slits S.

The inorganic heat insulation layer 16 turns into a low density black film with an insufficient level of oxygen or nitrogen through the process of reactive sputtering with high gas pressure; the resulting thermal diffusivity is from 0.3 $mm^2$/sec to 0.4 $mm^2$/sec. Therefore, in addition to its excellent heat insulation, it is highly adhesive since it contains free, active transition metal.

Thanks to the 5 to 20 $\mu$m thick inorganic heat insulation layer 16, the thermal head provides a sufficient mechanical strength to withstand repeated shearing stress applied to the heating elements 18*a* during printing, despite the presence of the underlying cavity 15.

Next, an inorganic protective layer 17 is laid over the inorganic heat insulation layer 16 to protect it; heating resistors 18 made of cermet with a high melting point are made on the inorganic protective layer 17.

The heating resistors 18 are annealed at a temperature not lower than 400° C. for stabilization. Electrodes, which include common electrodes 19 and an individual electrodes 20, are formed on the top surfaces of the heating resistors 18. Heating elements 18*a* are lined up like dots on the projecting area of the heating resistors 18 just above the cavity 15, between the common and individual electrodes 19 and 20.

The thickness of the electrodes 19 and 20 is so designed that they are flush with or lower than the heating elements 18*a*.

Last, an abrasion-resistant layer 21 is laid over the heating resistors 18, common electrodes 19 and individual electrodes 20 to cover them; a thermal head is thus finished by a manufacturing method according to the present invention.

In a thermal head according to the present invention, an inorganic protective layer made of a material chosen from among silicon or aluminum oxide, nitride and carbide is laid over the top surface of an inorganic heat insulation layer and heating elements are formed on the inorganic protective layer, between slits made through the inorganic heat insulation layer and inorganic protective layer to expose a cavity. Consequently, thermal diffusion from the heating elements to the heat radiation substrate is considerably reduced and the thermal head can accumulate heat efficiently to keep a temperature suitable for printing.

Also, in continuous printing, accumulated heat can be properly radiated so that the problem of excessive heat accumulation can be avoided.

Since the heating elements lie between slits over the inorganic heat insulation layer and the inorganic protective layer, the stress applied to the heating elements during printing can be absorbed by the inorganic layers between slits; therefore, a thermal head with a high thermal efficiency and a high mechanical strength can be provided.

The heating elements are formed on the bridge layer's area projecting upwards due to the cavity, between the individual and common electrodes facing each other, and the thickness of the electrodes is so designed that they are flush with or lower than the heating elements. This reduces the stress applied to the electrodes during printing.

For this reason, a longer service life of the electrodes is assured though they are made of a relatively soft material.

The bridge layer is made of a cermet as a compound of a metal with a high melting point and $SiO_2$ or a ceramic such as $SiO_2$, $Si_3N_4$ or Si—O—N so it can be made to adhere firmly to the glass heat insulation layer and inorganic heat insulation layer. This helps lengthen the service life of the thermal head.

The inorganic heat insulation layer is made of a complex oxide or complex nitride and its thickness is from 5 $\mu$m to 20 $\mu$m and its thermal diffusivity from 0.3 $mm^2$/sec to 0.4 $mm^2$/sec, so the thermal head provides both a high thermal efficiency and a longer service life.

The inorganic protective layer is made of an insulating ceramic such as $SiO_2$, SiC, Si—Al—O, $Al_2O_3$ or AlN and has a thickness of 0.1 to 1 $\mu$m, so chemical resistance, stress resistance, diffusion resistance and non-conductivity are maintained during the photolithographic process or heat treatment for the heating resistors.

Accordingly, the heating resistors can be made with high accuracy by a photolithographic technique so that fluctuations in the resistance value of the heating resistors can be minimized.

In the manufacturing method for a thermal head according to the present invention, an inorganic protective layer is laid over an inorganic heat insulation layer and the heating resistors and the electrodes are formed on the inorganic protective layer, so a thermal head with a high thermal efficiency and a high durability can be produced at a lower cost.

This manufacturing method makes it possible to produce a power saving thermal head suitable for use in a mobile printer such as a battery-powered model.

The sacrificial layer uses either Al, Cu or Mo as its material and has a height of 0.1 to 2 $\mu$m, so it can be easily removed by a photolithographic technique in order to make a cavity, leading to an easier thermal head production process.

The inorganic heat insulation layer is formed on the top surface of the bridge layer including the slits by sputtering, which also contributes to an easier production process.

What is claimed is:

1. A thermal head comprising:

a heat insulation layer formed on a heat radiation substrate;

a bridge layer of one of cermet and ceramic material is formed on the heat insulation layer, a cavity disposed between a portion of the bridge layer and the heat insulation layer, a plurality of slits disposed in the portion of the bridge layer overlying the cavity to expose the cavity;

a highly adiabatic inorganic heat insulation layer formed on a portion of the bridge layer that includes the slits;

an inorganic protective layer of a material selected from among one of silicon and aluminum oxide, nitride and carbide formed on the inorganic heat insulation layer;

a plurality of heating elements lined up on the inorganic protective layer and formed between neighboring slits; and an abrasion-resistant layer covering at least top surfaces of the heating elements.

2. The thermal head according to claim 1, further comprising electrodes formed on the heating elements to supply power to the heating elements, wherein the heating elements are formed on an area of the inorganic protective layer that projects upwards away from the heat radiation substrate due to the presence of the cavity compared with an area of the inorganic protective layer that does not have the cavity disposed therein under, and wherein the electrodes are one of flush with and lower than the heating elements.

3. The thermal head according to claim 1, wherein the bridge layer is made of one of a cermet and a ceramic, the cermet is formed of a compound of a metal with a high melting point and $SiO_2$, and the ceramic is selected from $SiO_2$, $Si_3N_4$ or Si—O—N.

4. The thermal head according to claim 1, wherein the inorganic heat insulation layer is one of a complex oxide and complex nitride that includes one of silicon and a transition metal as well as one of oxygen and nitrogen, respectively, and wherein a thickness of the inorganic heat insulation layer is from 5 $\mu$m to 20 $\mu$m and a thermal diffusivity of the inorganic heat insulation layer from 0.3 $mm^2$/sec to 0.4 $mm^2$/sec.

5. The thermal head according to claim 1, wherein the inorganic protective layer is an insulating ceramic selected from $SiO_2$, SiC, Si—Al—O, $Al_2O_3$ and AlN with a thickness of 0.1 to 1 $\mu$m.

6. A method for fabricating a thermal head having decreased heat accumulation, the method comprising:

forming a heat insulation layer on a heat radiation substrate;

forming a sacrificial layer of transition metal on the heat insulation layer;

forming a bridge layer of one of cermet and ceramic material on the heat insulation layer and the sacrificial layer;

removing the sacrificial layer to form a cavity;

introducing a plurality of slits in the bridge layer overlying the cavity to expose the cavity;

forming a highly adiabatic inorganic heat insulation layer on a portion of the bridge layer that includes the slits;

forming an inorganic protective layer of a material selected from among one of silicon and aluminum oxide, nitride and carbide on the inorganic heat insulation layer;

forming a plurality of heating elements on the inorganic protective layer and between neighboring slits; and forming an abrasion-resistant layer to cover the heating elements.

7. The method of claim 6, further comprising forming electrodes on the heating elements to supply power to the heating elements.

8. The method of claim 7, further comprising forming the heating elements on an area of the inorganic protective layer that projects upwards away from the heat radiation substrate due to the presence of the cavity compared with an area of the inorganic protective layer that does not have the cavity disposed thereinunder, and forming the electrodes to be one of flush with and lower than the heating elements.

* * * * *